US006644420B2

(12) United States Patent
Lay

(10) Patent No.: US 6,644,420 B2
(45) Date of Patent: Nov. 11, 2003

(54) COMPRESSED AIR TOOL

(75) Inventor: Norbert Lay, Bondorf (DE)

(73) Assignee: Schmid & Wezel GmbH & Co., Maulbronn (DE)

( * ) Notice: Subject to any disclaimer, the term of this patent is extended or adjusted under 35 U.S.C. 154(b) by 0 days.

(21) Appl. No.: 10/085,020

(22) Filed: Mar. 1, 2002

(65) Prior Publication Data

US 2002/0121385 A1 Sep. 5, 2002

(30) Foreign Application Priority Data

Mar. 1, 2001 (DE) ..... 201 03 600

(51) Int. Cl.[7] ..... F03B 13/04

(52) U.S. Cl. ..... 173/178; 173/218; 173/221; 173/93; 415/123; 415/904

(58) Field of Search ..... 173/178, 218, 173/221, 93; 415/123, 904; 418/43

(56) References Cited

U.S. PATENT DOCUMENTS 3,709,630 A * 1/1973 Pohl et al. ..... 173/218
3,952,814 A * 4/1976 Gelfand et al. ..... 173/93
4,141,671 A * 2/1979 Tarsoly ..... 173/221
4,776,752 A * 10/1988 Davis ..... 415/25
5,186,603 A * 2/1993 Kishi ..... 415/904
5,261,233 A * 11/1993 Kishi ..... 173/218
5,439,346 A * 8/1995 Bowser et al. ..... 415/18
6,085,849 A * 7/2000 Scigliuto ..... 173/178

FOREIGN PATENT DOCUMENTS

DE 4132187 C2 11/1996
DE 4213610 C2 2/1998
EP 0719377 B1 4/1999

* cited by examiner

*Primary Examiner*—Scott A. Smith
(74) *Attorney, Agent, or Firm*—Jones, Tullar & Cooper, P.C.

(57) ABSTRACT

A turning device for compressed air tools. which is operated by a compressed fluid, is provided with a housing and with a rotor, which is rotatably arranged in a front housing part and into whose turbine element the fluid, which is under pressure, can flow, has a braking arrangement and a switch for the compressed fluid. The switch which is operatively connected with the braking arrangement and is arranged on a rear housing part in line with a compressed fluid supply conduit. Such a turning device requires fewer components and can be stopped in a simpler and faster way by a fluid switch, in the form of a sliding switch, which encloses the rear housing part in the area of the supply conduit and is provided with axially oriented control pins, which are connected, fixed against relative displacement, with a brake disk of the braking arrangement.

6 Claims, 2 Drawing Sheets

COMPRESSED AIR TOOL

FIELD OF THE INVENTION

The invention relates to a turning device operated by compressed air, for example for compressed air tools, having a housing and a rotor, which is rotatably arranged in a front housing part and into whose turbine element the fluid under pressure can flow, having a braking arrangement and a switch for the compressed fluid, which is in operative connection with the braking arrangement and is arranged on a rear housing part in line with a compressed fluid supply conduit.

BACKGROUND OF THE INVENTION

With such a turning device known from U.S. Pat. No. 5,186,603, the switch constitutes at least partially the rear housing part and can be rotated in a screw thread in relation to the front housing part and a housing cover which receives it. The supply with compressed fluid is opened or closed by means of this rotation. The braking arrangement is spring-loaded and is pressed on the rotor in the course of closing the compressed fluid supply conduit when the switch is turned.

The construction of this known turning device is comparatively elaborate and requires a multitude of components. Moreover, opening and closing the compressed fluid supply conduit cannot be performed with one hand and is therefore impractical and furthermore time-consuming because of the multitude of required revolutions.

OBJECT AND SUMMARY OF THE INVENTION

It is the object of the present invention to create a turning device of the type mentioned at the outset which requires fewer components and which can be brought to a stop in a simpler and faster way by means of a fluid switch.

This object is achieved by the provision of a sliding switch which encloses the rear housing part in the area of the supply conduit. The sliding switch is provided with axially oriented control pins which are connected and fixed against relative displacement with a brake disk of the braking arrangement.

By means of the steps of the present invention it is achieved that the switch is embodied as a simple sliding switch which cannot only be operated with one hand, but also in a very rapid manner. The direct opening and closing of the braking arrangement by means of the sliding switch is possible because of the slide-proof connection of the brake disk and the sliding switch without requiring further components.

A slide-proof guide for the control pins is achieved by means of a cover of the housing through which the control pins are guided With the provision of vent openings in the housing cover, venting can take place simultaneously with the shut-off and braking of the rotor.

Advantageous embodiments with respect to opening and closing the compressed fluid supply conduit with the aid of the sliding switch ensue due to the supply conduit being interrupted in the rear housing part, with each end of the supply conduit being connected with radial bypass conduits arranged in the rear housing part whose outlet openings can be covered by the sliding switch; due to the sliding switch having an interior annular compressed fluid groove whose width corresponds to the axial distance of the bypass conduits from both ends of the conduit; and due to seal rings being provided in the sliding switch at both sides of the annular groove, the center seal ring of which separates the two bypass conduits.

Further details of the present invention can be taken from the following description, in which the present invention is described in greater detail and explained by means of the exemplary embodiment represented in the drawings.

DETAILED DESCRIPTION OF THE PREFERRED EMBODIMENT

Figure 1:
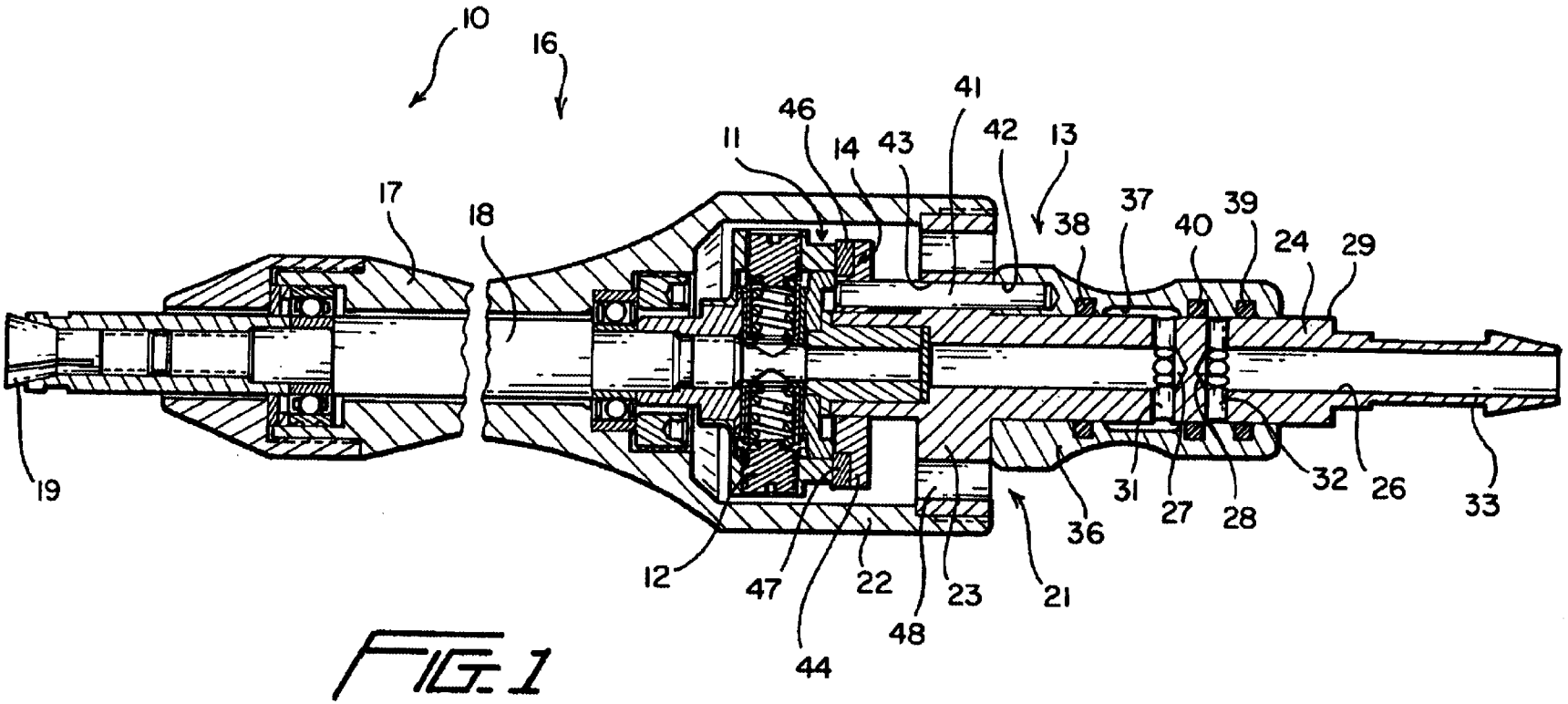
FIG. 1 represents a compressed air tool provided with a turning device in accordance with a preferred exemplary embodiment of the invention in the switched off and braked position in longitudinal section and truncated form, and FIG. 2 a truncated representation corresponding to FIG. 1, but in the operating position.

The compressed air tool 10 represented in the drawings has a turning device 11, which has a rotor 12, for example in the form of a turbine, which can be charged with compressed air and in this way caused to rotate. The supply of compressed air can be turned on or off by means of a sliding switch 13, wherein a braking arrangement 14 acts on the rotor 12 simultaneously with the shutoff of compressed air by means of the sliding switch 13.

The compressed air tool 10 has an elongated housing 16 surrounding a drive shaft 18, which is connected, fixed against relative rotation, with the rotor 12 and is provided with a clamping chuck 19 on its end projecting out of the housing 16. The drive shaft 18 is rotatably seated in the housing 16 in the area close to the rotor 12, as well as in the area remote from the rotor 12 and close to the clamping chuck 19.

Figure 2:
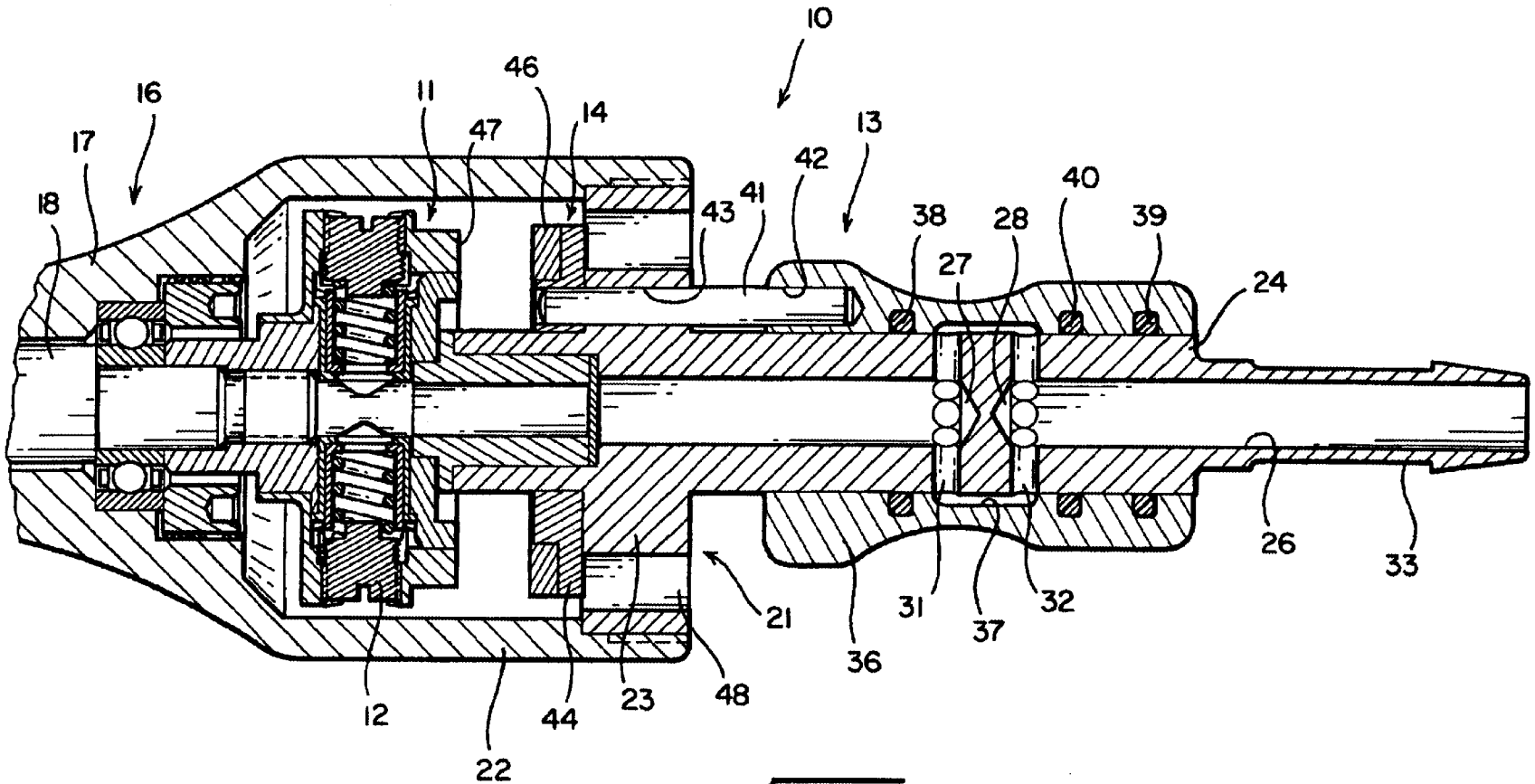

The front housing part 17, which faces the rear housing part 21 and can be connected with it, is embodied in a cup shape on one end 22. The cup-shaped end 22 is closed by a cover element 23 of the rear housing part 21. A tube element 24 of the rear housing part 21 passes through the cover element 23, which tube element 24 has an axially centered, axial supply conduit 26 for the compressed air. Here, the cover element 23 and the tube element 24 are one piece. The supply conduit 26 terminates in the turbine rotor 12. The supply conduit 26 is interrupted in the tube element 24 outside of the cover element 23. Several radial bypass conduits 31, or 32, which extend from the outer circumference of the tube element 24 and are respectively arranged evenly distributed over the circumference, terminate in the closed ends 27 and 28 of the supply conduit 26 which are facing each other. A sleeve-shaped slide 36 is axially movable on the tube element 24 provided with a smooth cylindrical exterior circumference 29 and provided with a connecting end 33 for a compressed air connection. The sleeve-shaped slide 36 is used as a switch for supplying and blocking compressed air supplied via the supply conduit 26 and used for driving the turning device 11. The slide 36 has an interior annular groove 37 which can connect the radial bypass conduits 31 and 32 of the two closed supply conduit ends 27 and 28 with each other. In accordance with FIG. 2, the annular groove 37 has a width corresponding to the radial bypass conduits 31 and 32, so that in the connected position of the sliding switch 36 the outlet openings of the radial bypass conduits 31 and 32 are covered by the annular groove 37 and are connected. An O-ring 33, or two O-rings 39 and 40, are arranged on both sides of the annular groove 37 and prevent leaks to the outside in the connected state and, in the state of the sliding switch 36 in which it interrupts the compressed air supply, the center O-ring 40 of which is arranged at a place between the two radial bypass conduits 31 and 32 (FIG. 1). In this position the bypass conduits 31 are not connected with the bypass conduits 32, so that the compressed air supply is interrupted.

The sleeve-shaped slide 36 has several, for example three, control pins 41, which are arranged evenly distributed over the circumference and extend in the axial direction. The control pins 41 are maintained with one end in blind bores 42 of the sleeve-shaped slide 36, pass through guide bores 43 in the cover element 23 in an axially movable manner and on their end located inside the cup-shaped end 22 of the front housing part 17 are connected, fixed against relative displacement, with a brake disk 44 of the braking arrangement 14. The brake disk 44, which is equipped with a ring-shaped brake lining 46, is axially movable on the inner end of the tube element 24 facing the rotor 12.

A connection, fixed against relative displacement, of the slide 36 with the brake disk 44 is provided with the aid of the axial control pins 41 so that, when the sliding switch 36 is in a position where it interrupts the supply of compressed air (FIG. 1), the brake disk 44 presses with its brake lining 46 against an annular front 47 of the rotor 12. In accordance with FIG. 2, when the compressed air supply is open, the brake disk 44 is at an axial distance from the rotor 12. The cover element 23 is furthermore provided with axial vent openings 48 for venting during operation.

Even though the turning device 11 has been described in connection with a compressed air tool 10, it is understood that the turning device 11 can also be employed with a tool operated by means of a different compressed fluid.

What is claimed is:

1. A turning device operated by compressed air, having:

a housing including a front housing part and a rear housing part;

a rotor rotatably arranged in said front housing part, said rotor including a turbine element into which fluid under pressure can flow;

a braking arrangement including a brake disk;

a switch operatively connected to said braking arrangement, said switch being arranged on said rear housing part;

compressed fluid supply conduit situated in line with said switch, wherein:

said switch is embodied as a sliding switch which encloses said rear housing part in the area of said compressed fluid supply conduit, said sliding switch being provided with a plurality of axially oriented control pins which are fixed against relative displacement and connected with said brake disk.

2. The turning device as defined in claim 1, further comprising:

a cover of said housing, wherein said plurality of control pins are guided in and through said cover.

3. The turning device as defined in claim 2, wherein said cover is supplied with vent openings.

4. The turning device as defined in claim 1, further comprising:

radial bypass conduits arranged in said rear housing part and defining outlet openings, wherein said compressed fluid supply conduit is interrupted in said rear housing part, with each end of said compressed fluid supply conduit being connected with one of said radial bypass conduits, and wherein said sliding switch adapted to cover said outlet openings.

5. The turning device as defined in claim 4, wherein said sliding switch has an interior annular compressed fluid groove, whose width corresponds to the axial distance of said bypass conduits from both ends of said supply conduit.

6. The turning device as defined in claim 5, further comprising:

seal rings provided in said sliding switch at both sides of said annular groove, with a center seal ring separating the two bypass conduits.

* * * * *